United States Patent [19]

Biginelli

[11] Patent Number: 4,975,305

[45] Date of Patent: Dec. 4, 1990

[54] PROCESS AND APPARATUS FOR METAL SPRAYING OF ARTICLES

[76] Inventor: Pier C. Biginelli, Strada S. Maria 64, 10040 Givoletto, Italy

[21] Appl. No.: 328,171

[22] Filed: Mar. 24, 1989

[30] Foreign Application Priority Data

Jun. 17, 1988 [IT] Italy ..... 67570 A/88

[51] Int. Cl.[5] ..... B05D 3/00

[52] U.S. Cl. ..... 427/354; 98/115.2; 118/315; 427/380; 427/393.5; 427/412.1

[58] Field of Search ..... 427/354, 380, 382, 408, 427/409, 412.1, 393.5; 98/115.2; 118/315

[56] References Cited

U.S. PATENT DOCUMENTS 3,861,989 1/1978 Aschenfarb et al. ..... 427/165

*Primary Examiner*—Michael Lusignan

*Attorney, Agent, or Firm*—Renner, Otto, Boisselle & Sklar

[57] ABSTRACT

A process for metal spraying of articles is disclosed which comprises forming a metal silver film over the article surface, the film being obtained by reduction of silver nitride in an ammoniacal complex through a water solution of a reducing sugar, preferably glucose.

The process further comprises an initial step or forming a primer layer of alkyd resin, a step in which a solution of stannous chloride is applied to activate the following reaction to form the silver film, and a final step in which a protection varnish is applied, a swell as intermediate steps of washing and drying.

The process is applicable to plastic, wood or metal articles.

It is further disclosed an apparatus adapted to carry out some steps of the process which comprises a spray booth equipped with pressurized vessels and spraying devices to uniformly apply the reactives to form the silver layer over the article surface.

4 Claims, 1 Drawing Sheet

PROCESS AND APPARATUS FOR METAL SPRAYING OF ARTICLES

BACKGROUND OF THE INVENTION

This invention relates to a process and an apparatus for metal painting or spraying of articles.

There are plastic articles that require a painting with a metallic effect; however it is known that it is difficult to obtain such effect with the conventional paints, particularly when a strongly bright and reflecting surface, e.g. a mirrorlike surface, is desired.

As an example, many stage components or furnishings of shows and exhibitions, as well as many car prototypes advantageously can be realized of plastics or wood instead of metal. In fact, plastics or wood, due to their light weight, easiness of transport and low cost which features are quite relevant for use in stage setting or due to their better workability in respect of metals, are materials quite convenient in making industrial patterns. It is of particular interest the construction of such patterns in plastic foam in view of the light weight, the availability and the low cost of this material.

The acceptance of these materials is however limited by the difficulties to impart to the articles a surface finish conferring them a satisfying matallized appearance, or that of other noble materials, such as marble or granite.

In the field of painting very small objects, such as plastic car models and the like, it is known a metallic painting process providing for the formation of a metal silver mirror, similarly to the technique employed in mirror manufacturing, in which an ammoniacal solution of silver nitrate is reduced with a solution of formic aldehyde or other organic reducing agent such as glucose, thus obtaining a thin reflecting film of metal silver imparting the desired appearance to the object.

These techniques are not used however in forming films having a metallizing appearance over larger objects or complex shape three-dimensional objects wherein problems are encountered concerning the adhesion of the silver film to the object surface, the film uniformity and the time stability, leading to a deterioration of the article appearance.

As for what concerns the painting with metallic effect of metal articles, the conventional techniques of electro-painting or vacuum painting suffer from the limitation of not being usable for very large size objects, particularly since it is not possible to place such objects in the painting tanks.

The object of the present invention is therefore that of providing an effective process for painting with a metallizing effect, i.e. markedly bright-reflecting, both plastic and wood articles, even of large size and complex shape, particularly articles built from material usually difficult to be painted, such as polystyrene and other foam resins, polymethacrylates and resins filled with glass fibers.

Another object of the invention is that of providing an apparatus which allows to carry out the above process in a easy and optimum manner.

SUMMARY OF THE INVENTION

The above and other objects and advantages of the invention, which will become evident from the following description, are achieved through a process for metal spraying articles, characterized in that it comprises the following steps, in the specified order:

(a) applying over the article surface a primer layer of alkyd resin, in case with one or more pigments of the desired color added;

(b) drying said alkyd resin primer layer;

(c) applying over said primer layer an acid water solution comprising from 0.05 to 2% by volume of stannous chloride;

(d) washing with water the surface of the so treated article;

(e) simultaneously spraying over the article surface a water solution comprising from 0.5 to 3% of silver nitrate by volume in an ammoniacal complex, and a water solution from 1 to 5% by volume of a reducing sugar;

(f) washing with water the surface of the so treated article;

(g) applying over the article surface a varnish to form a protection film;

(h) drying the varnished surface so obtained.

A second object of the present invention resides in an apparatus for carrying out the above process, comprising a spray booth having a work area provided with a grilled surface for draining the excess paint toward a drain bore into a collecting vessel lying below, and a suction hood above said work area, characterized in that said spray booth further comprises a separate compartment housing three removable pressurized vessels containing the liquids forming part of the composition to be applied to the article to be sprayed, each of said vessels being equipped with a flexible drain duct ending with a spraying device, two of said ducts being parallely coupled for simultaneously applying to the article surface the two liquids contained in the associated vessels.

DESCRIPTION OF A PREFERRED EMBODIMENT

Hereinbelow it is given a detailed description of the invention, the apparatus of which will be disclosed later with reference to the attached drawings.

The articles that can advantageously be subjected to the spraying process according to the invention are in general plastic or wood articles that do not naturally provide for bright surfaces having a metallic appearance.

Among such articles there are indicated those by foam polystyrene, by polymethacrylate and synthetic resin reinforced with glass fibers.

By employing the process of the present invention it is possible to paint with a metallic effect also large size or tridimensional objects with complicated shape, provided that they expose surfaces that can be reached by the spraying. Of particular advantage is the situation for metal or metal alloy articles which cannot be painted through the conventional techniques.

The first step of the process provides for applying to the article surface an alkyd resin priming layer which proved to be adapted to render uniform the surface of the article and to form a very good supporting layer for the adesion of the other products to be applied later.

With the term "applying" in the present description it is meant the operation to uniformly spread a liquid product over the surface of the article. This operation can be carried out in several ways, although it is preferably carried out by spraying in view of the more uniform distribution of the product that can be obtained this way.

The alkyd resin is normally applied as a solution in a suitable solvent such as toluene, xylene, methylketone, ethyl acetate, in case with the addition of a pigment to impart a desired colored base to the article.

As an alkyd resin containing a pigment, a product marketed under trademark Centari 500 by DuPont de Nemours Co. can be used.

The steps of drying the products applied to the article can be carried out either at room temperature for about 24 hours or at 50° C. for about 2 hours.

The 0.05–2% by volume acid water solution of stannous chloride is applied over the dried primer layer of alkyd resin as an agent for activating and speeding up the subsequent reaction that reduces the silver ions to metallic silver.

The solution is acidified by means of concentrated hydrochloric acid up to a pH value comprised between 1 and 2.

The article surface treated with the stannous chloride solution is washed with deionized water, preferably distilled water, to prevent deposition of impurities over the finish layer being formed.

The step previously marked as (e) is the central step of the process. In this step there is formed the silver mirror imparting the metallic appearance to the surface.

The silver mirror is obtained by reducing the silver ions, through a reaction known in the analytic chemistry for the qualitative detection of aldheydes or aldoses and called "Tollens test".

To carry out this reaction for the purposes of the present invention, it is necessary to prepare a 0.5–3% by volume ammoniacal silver nitrate solution, wherein the silver is in the form of a diamine silver complex $Ag(NH_3)_2+$.

The solution is preferably prepared by adding a 5–30% by volume silver nitrate solution, which has been basified by means of concentrated ammonium hydroxide until the salt has completely dissolved, to a ten times larger volume of a water solution comprising 0.5M of ammonium hydroxide and 0.5M of sodium hydroxide.

The reduction of the silver ions to metal silver is obtained through a 1–5% by volume water solution of a reducing sugar, preferably a 2% glucose solution.

It has also been found that the reaction is improved when the reducing sugar solution is acidified by means of sulphuric acid.

The ammoniacal silver nitrate solution and the acid solution of the reducing sugar are simultaneously but separatedly sprayed, i.e. by means of two separated although converging nozzles, in order that the mixing and the reaction of silver reduction do not take place before the reagents are near to or in contact with the article surface.

At this step of the process, on the article surface there is formed a silver mirror which imparts to the same the desired metallized appearance and which covers the base coloring, if present, applied during the above step (a).

The step of forming the silver mirror is followed by a water washing step to remove the possible excess of reagents that have not reacted.

At this point it is necessary to stabilize the metallizing layer by forming a protection film thereon. To this aim a transparent coating or varnish of the epoxy, polyurethane, acrylic or similar type is used, which is preferably sprayed over the article surface.

As an example, a product sold under the trademark Lucite by DuPont de Nemours Co. can be used.

The last process step consists in drying this varnish at 50° C. for two hours, or at room temperature for 24 hours.

BRIEF DESCRIPTION OF THE DRAWING

The apparatus for carrying out the process of the invention in an optimum way is illustrated, only as a non limiting example, in the attached drawings in which.

DETAILED DESCRIPTION OF THE DRAWINGS

Figure 1:
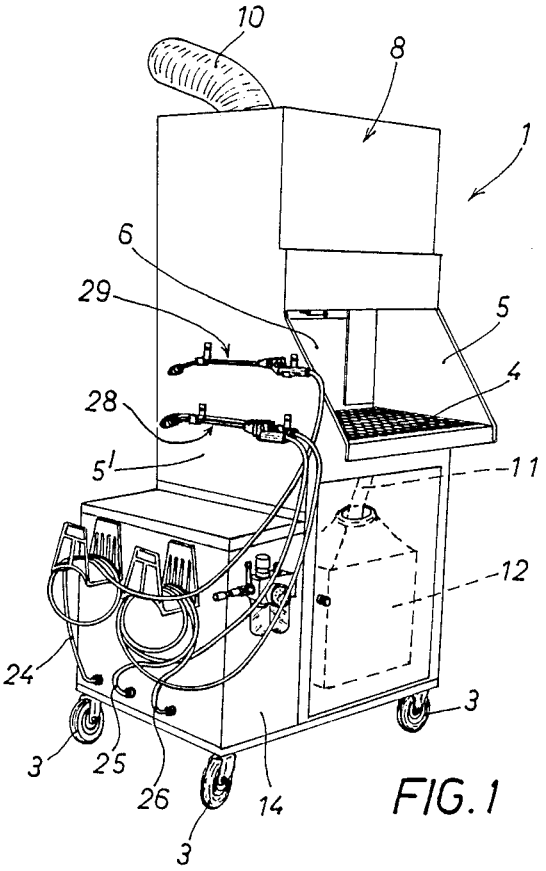
FIG. 1 is a perspective view of a spray booth according to the invention.
Figure 3:
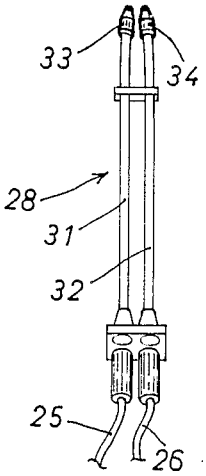
FIG. 3 is a plan view of another enlarged detail of FIG. 1.
Figure 2:
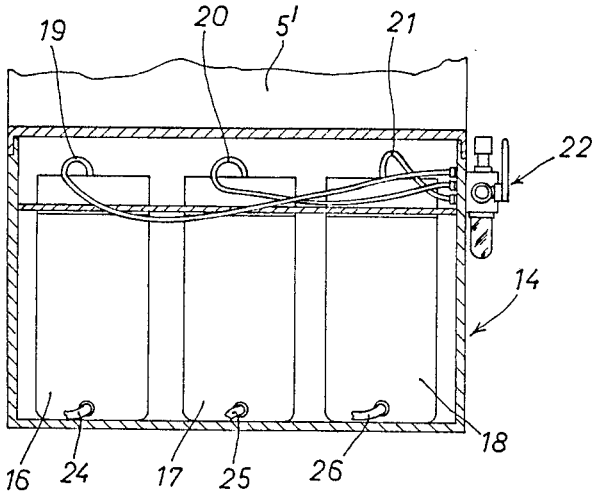
FIG. 2 is a sectional view of an enlarged detail of FIG. 1.

Referring to the Figures, the apparatus substantially comprises a spray booth designated in general by 1, and equipped with wheels 3 so as to be easily moved.

The working area is made up by a grilled surface 4 closed by side walls 5, 5', by a rear wall and by a hood 8 with suction means to convey the vapors into an exhaust duct 10.

The excess of paint is collected, through a drain duct 11, into a collect vessel 12 below the grilled surface.

Keeping in mind that the main operations of the above illustrated process consist in the simultaneous application of an ammomiacal solution of silver nitrate and of a solution of a reducing sugar, which are preceded and followed by the steps of washing the article to be painted, the spray booth has been equipped with containers of the above products and with means to apply them.

Namely, the booth 1 carries an outer compartment 14 acting as a container for three vessels 16, 17 and 18 of the washing liquid, the ammoniacal silver nitrate solution, and the water solution of the reducing sugar, respectively. To this aim the vessels are provided with sealing cover, not shown since they are of known type.

The vessels 16, 17 and 18 are adapted to be pressurized through ducts 19, 20 and 21 supplying air under pressure through an inlet faucet 22 on which a filter and a pressure gauge can be mounted.

The vessels are further provided on their lower portion with outlet bores for the liquid, which are connected to flexible ducts 24, 25 and 26, the other ends of which are connected to the devices for applying the liquid over the article to be painted.

The applying devices comprises spray guns or blowpipes ending with atomizing nozzles 28 and 29 known per se.

It is to be noted that as a matter of fact the blowpipe 28 is formed by two parallely coupled ducts 31 and 32, each being connected to an atomizing nozzle 33, 34 mounted in such a manner to be slightly diverging. The solutions of silver nitrate and reducing sugar are applied through these two nozzles, in such a way that they can intimately mix together only on the surface to be painted or on the immediately surrounding area. Therefore the construction of the device for applying the solutions is important to obtain an even distribution of the liquids over the article surface.

On the contrary, the blowpipe 29 is made up by a single duct as is used to apply the washing liquid.

In order to apply the remaining products conventional spray systems such as airbrushes and the like can be used.

A preferred embodiment of the invention has been illustrated, but of course to this latter several modifications and changes can be made within the scope of the inventive idea.

I claim:

1. A process for metal spraying plastic articles, comprising the following steps, in the specified order:

a. applying on the plastic article surface a primer layer of a one-component alkyd resin, in case with one or more pigments of the desired color added;

b. drying said alkyd resin primer layer;

c. applying on said primer layer an acid water solution comprising from 0.05 to 2% by volume of stannous chloride;

d. washing with water the surface of the so treated plastic article;

e. simultaneously spraying over the plastic article surface a water solution comprising from 0.5 to 3% of silver nitrate by volume in an ammoniacal complex, and a water solution from 1 to 5% by volume of a reducing sugar to cause deposition of a layer of silver on said primer layer of alkyd resin;

f. washing with water the surface of the so treated plastic article;

g. applying on said layer of silver a varnish to form a protection film;

h. drying the varnished film so obtained.

2. A process for metal spraying as claimed in claim 1, characterized in that said water solution comprising from 0.5 to 3% of silver nitrate in an ammoniacal complex is prepared by adding a 5–30% by volume silver nitrate solution, which has been basified by means of concentrated ammonium hydroxide until the salt has completely dissolved, to a ten times larger volume of a water solution comprising 0.5M of ammonium hydroxide and 0.5M of sodium hydroxide.

3. A process for metal spraying as claimed in claim 1, characterized in that the simultaneous spraying of the ammoniacal silver nitrate and reducing sugar solutions is carried out by mixing the solutions that are directly sprayed over the surface, or in the nearby area, of the plastic article to be painted.

4. The process of claim 1 wherein said alkyd resin primer layer is dried at a temperature up to about 50° C.

* * * * *